US011581676B2

(12) United States Patent
Raybold et al.

(10) Patent No.: US 11,581,676 B2
(45) Date of Patent: Feb. 14, 2023

(54) PIN TERMINAL ASSEMBLY

(71) Applicant: TE Connectivity Services GmbH, Schaffhausen (CH)

(72) Inventors: Christopher Ryan Raybold, Middletown, PA (US); John Mark Myer, Middletown, PA (US)

(73) Assignee: TE Connectivity Solutions GmbH

( * ) Notice: Subject to any disclaimer, the term of this patent is extended or adjusted under 35 U.S.C. 154(b) by 0 days.

(21) Appl. No.: 17/015,806

(22) Filed: Sep. 9, 2020

(65) Prior Publication Data

US 2022/0077619 A1 Mar. 10, 2022

(51) Int. Cl.

| | |
|---|---|
| ***H01R 13/52*** | (2006.01) |
| ***H01R 13/405*** | (2006.01) |
| ***H01R 13/66*** | (2006.01) |
| ***H01R 4/20*** | (2006.01) |
| ***H01R 4/02*** | (2006.01) |

(52) U.S. Cl.

CPC ..... *H01R 13/405* (2013.01); *H01R 4/029* (2013.01); *H01R 4/20* (2013.01); *H01R 13/521* (2013.01); *H01R 13/6683* (2013.01)

(58) Field of Classification Search

None

See application file for complete search history.

(56) References Cited

U.S. PATENT DOCUMENTS

| | | | | |
|---|---|---|---|---|
| 6,582,251 | B1 * | 6/2003 | Burke | H01R 13/5202 439/589 |
| 7,357,681 | B2 * | 4/2008 | Yamagami | H01R 13/03 439/886 |
| 9,444,167 | B2 * | 9/2016 | Fukushima | H01R 13/405 |
| 9,960,531 | B2 * | 5/2018 | Poncini | H01R 13/502 |
| 10,153,598 | B2 * | 12/2018 | Watanabe | H01R 13/582 |
| 10,850,631 | B2 * | 12/2020 | Myer | B60L 53/16 |
| 2018/0062298 | A1 * | 3/2018 | Mogi | H01R 27/02 |
| 2020/0176916 | A1 * | 6/2020 | Nakamura | H01R 13/6581 |

* cited by examiner

*Primary Examiner* — Felix O Figueroa

(57) ABSTRACT

A pin terminal assembly includes a pin terminal having a retention section and a cavity adaptor formed of a non-conductive material and engaging the retention section. The cavity adaptor has an outer shape corresponding to a cavity of a housing in which the pin terminal is inserted. The cavity adaptor retains the pin terminal in the cavity.

22 Claims, 6 Drawing Sheets

PIN TERMINAL ASSEMBLY

FIELD OF THE INVENTION

The present invention relates to a pin terminal and, more particularly, to a pin terminal retained in a cavity of a housing.

BACKGROUND

An electrical connector commonly includes a housing and a pin terminal disposed in a cavity of the housing. The shape of the pin terminal is adapted to the shape of the cavity in order to retain the pin terminal in the housing. The cavities of various housings have different shapes and, consequently, differently shaped pin terminals are designed and produced for each of the different cavities.

Due to the complex geometry of the pin terminal required for each of the different cavities, the different pin terminals are commonly produced by screw machining. The pin terminal is often formed from an expensive conductive material, leading to significant waste from the screw machining production process. The individualized production of the different pin terminals further leads to low manufacturing efficiency. Pin terminals shaped to be retained in a cavity of a housing are thus costly to produce and have limited flexibility in application.

SUMMARY

A pin terminal assembly includes a pin terminal having a retention section and a cavity adaptor formed of a non-conductive material and engaging the retention section. The cavity adaptor has an outer shape corresponding to a cavity of a housing in which the pin terminal is inserted. The cavity adaptor retains the pin terminal in the cavity.

BRIEF DESCRIPTION OF THE DRAWINGS

The invention will now be described by way of example with reference to the accompanying Figures, of which.

DETAILED DESCRIPTION OF THE EMBODIMENTS

Figure 1:
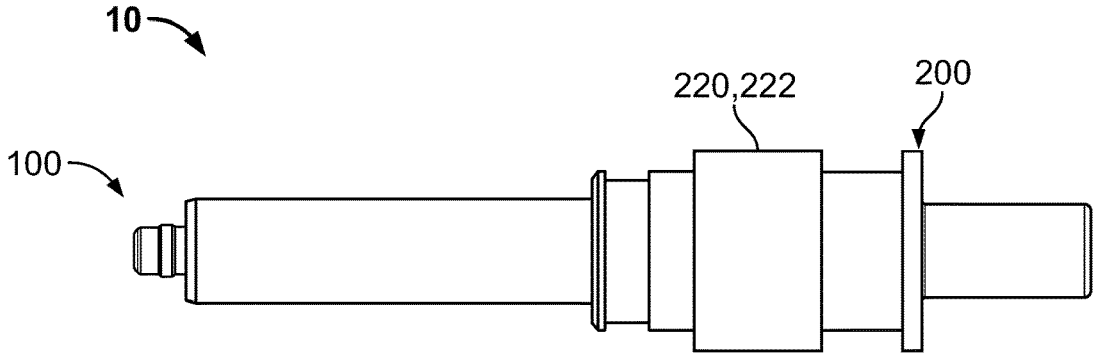
FIG. 1 is a side view of a pin terminal assembly according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

Figure 3:
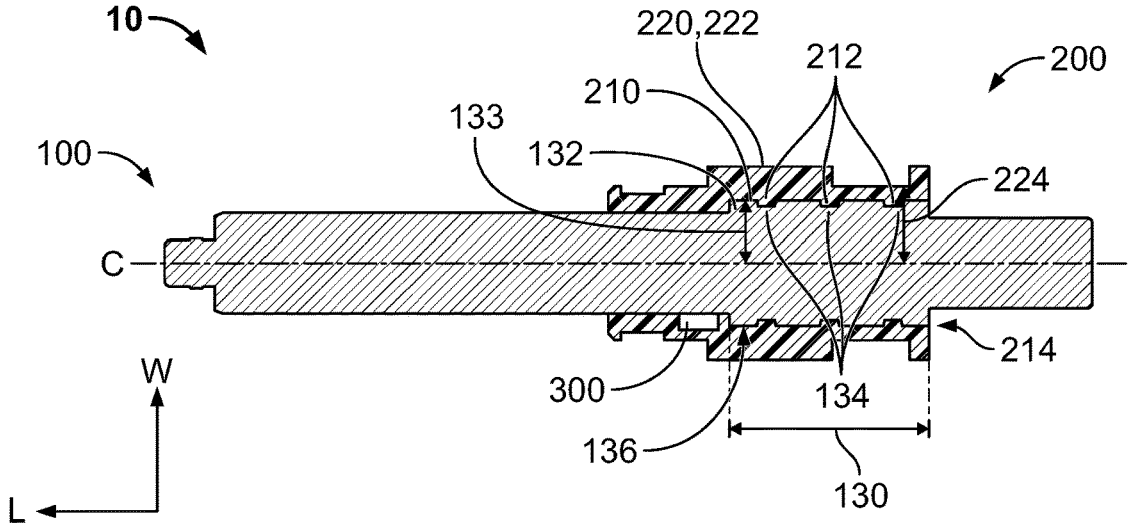
FIG. 3 is a sectional side view of the pin terminal assembly of FIG. 1.

A pin terminal assembly 10 according to an embodiment, as shown in FIGS. 1 and 3, includes a pin terminal 100 and a cavity adaptor 200 disposed on the pin terminal 100.

Figure 2:
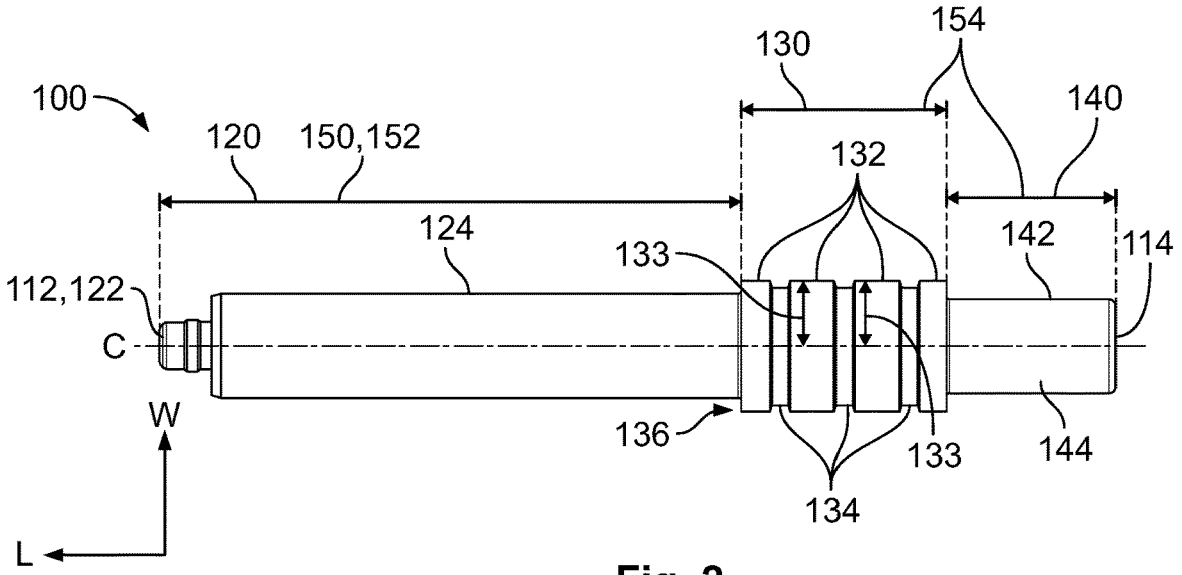
FIG. 2 is a side view of a pin terminal of the pin terminal assembly of FIG. 1.

The pin terminal 100, as shown in FIG. 2, has a first end 112 and extends in a longitudinal direction L to a second end 114 opposite to the first end 114. Along the longitudinal direction L, the pin terminal 100 includes a first connecting section 120 starting at the first end 112, a retention section 130 connected to and extending from the first connection section 120, and a second connecting section 140 connected to the retention section 130 and extending to the second end 114.

The pin terminal 100, as shown in FIGS. 2 and 3, has a central axis C extending centrally through the pin terminal 100 along the longitudinal direction L. In the shown embodiment, the pin terminal 100 has a circular cross-sectional shape. In other embodiments, the pin terminal 100 may have any other cross-sectional shape used in pin terminals.

The first connecting section 120, as shown in FIG. 2, has a cap mount 122 at the first end 112. The first connecting section 120 has a first connecting surface 124 adapted to contact and form an electrical connection with a first external component.

The retention section 130, as shown in FIG. 2, has a plurality of pin protrusions 132 and a plurality of grooves 134 disposed between the pin protrusions 132. Each of the grooves 134 is disposed between a pair of adjacent pin protrusions 132. The pin protrusions 132 and grooves 134 define an outer profile 136 of the retention section 130 extending along the longitudinal direction L.

As shown in FIG. 2, each of the pin protrusions 132 extends a protrusion distance 133 from the central axis C in a width direction W perpendicular to the longitudinal direction L. The protrusion distance 133 is the same for each of the pin protrusions 132. The protrusion distance 133 is greater than a distance of the first connecting surface 124 from the central axis C in the width direction W and protrudes beyond the first connecting surface 124. The protrusion distance 133 is also greater than a distance of each of the grooves 134 from the central axis C in the width direction W, forming the grooves 134 in the retention section 130. In the embodiment shown in FIG. 2, the grooves 134 extend a greater distance from the central axis C in the width direction W than the first connecting surface 124. In other embodiments, the grooves 134 may extend a same distance from the central axis C as the first connecting surface 124 or may extend a smaller distance from the central axis C than the first connecting surface 124.

The second connecting section 140, as shown in FIG. 2, has a second connecting surface 142 that protrudes a smaller distance from the central axis C than the protrusion distance 133. The second connecting surface 142 is adapted to contact and form an electrical connection with a second external component. In the embodiment shown in FIG. 2, the second connecting section 140 is a solid cylindrical portion 144. The second connecting section 140 may be formed differently in other embodiments, as shown and described in greater detail below.

In the embodiment shown in FIGS. 1-3, the pin terminal 100 is monolithically formed in a single piece from a conductive material. In an embodiment, the pin terminal 100 is forged from the conductive material. In an embodiment, the conductive material is a highly conductive material, such as a material including copper. The outer profile 136 of the retention section 130 allows the pin terminal 100 to be forged and produced more simply and economically than other manufacturing methods, such as screw machining.

The pin terminal 100 has a plated portion 150 and an unplated portion 154, as shown in FIG. 2. The plated portion 150 has a plating 152. The plating 152, in an embodiment, is a silver material, but the plating 152 can be other plating materials in other embodiments. The plating 152 may be applied in the plated portion 150 by rack plating. In other embodiments, other methods of plating can be used to form the plated portion 150. The unplated portion 154 does not have the plating 152 and instead includes only the material from which the pin terminal 100 is forged.

In the embodiment shown in FIG. 2, the first connecting section 120 is in the plated portion 150 and has the plating 152. The retention section 130 and the second connecting section 140 are in the unplated portion 154. In another embodiment, the second connecting section 140 can also be part of the plated portion 150.

The cavity adaptor 200 is formed of a non-conductive material and, as shown in FIG. 3, has an inner surface 210 contacting the pin terminal 100 and an outer surface 220 positioned distal from the pin terminal 100. In an embodiment, the non-conductive material of the cavity adaptor 200 is a high temperature thermoplastic or a thermoset.

The cavity adaptor 200, as shown in FIGS. 1 and 3, is overmolded on the retention section 130 and engages the retention section 130. The overmolding of the cavity adaptor 200 forms a plurality of adaptor protrusions 212 on the inner surface 210, with each of the adaptor protrusions 212 engaging one of the grooves 134. The engagement of the adaptor protrusions 212 with the grooves 134 prevents movement of the cavity adaptor 200 with respect to the pin terminal 100 along the longitudinal direction L. The overmolding creates a serpentine profile 214 on the inner surface 210 that includes the adaptor protrusions 212. The serpentine profile 214 corresponds to the outer profile 136 of the retention section 130 and helps mitigate any electrical leak path that may occur between the pin terminal 100 and the cavity adaptor 200.

As shown in FIG. 3, the outer surface 220 has an outer shape 222 that varies in distance from the central axis C along the longitudinal direction L. The outer shape 222 has an adaptor distance 224 from the central axis C in a portion of the cavity adaptor 200 aligned with the retention section 130 in the width direction W. The adaptor distance 224 varies with the variation of the outer shape 222 along the longitudinal direction L. The adaptor distance 224, at a minimum, has a greater distance from the central axis C than the protrusion distance 133 of the pin protrusions 132.

The pin terminal assembly 10, in the embodiment shown in FIG. 3, includes a temperature sensor 300 disposed in the cavity adaptor 200 and positioned against the pin terminal 100. The temperature sensor 300 is molded in the cavity adaptor 200 during the overmolding process. The temperature sensor 300 is adapted to detect a temperature of the pin terminal 100 as an electrical current flows through the pin terminal 100. In an embodiment, the temperature sensor 300 is a thermocouple. The particular position of the temperature sensor 300 in the embodiment shown in FIG. 3 is merely exemplary; the temperature sensor 300 can be disposed at other positions within the cavity adaptor 200 as long as the temperature sensor 300 is in contact with the pin terminal 100.

The pin terminal assembly 10 is shown in an assembled state with the cavity adaptor 200 overmolded on the pin terminal 100 in FIG. 1. The pin terminal assembly 10 in the assembled state, as shown in FIG. 4, is disposed in a cavity 62 of a housing 60 to form a connector 1 according to an embodiment.

Figure 4:
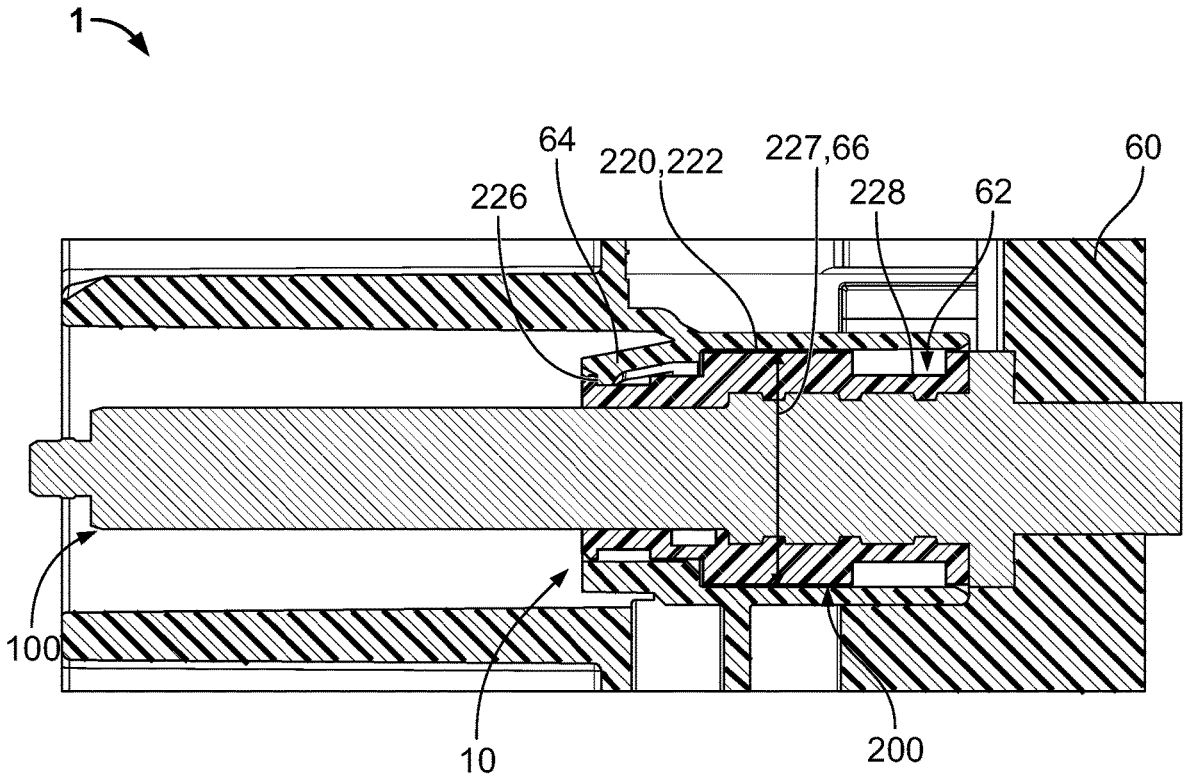
FIG. 4 is a sectional side view of a connector according to an embodiment.

As shown in FIG. 4, the outer shape 222 of the cavity adaptor 200 is formed during the overmolding to correspond to the cavity 62 and, due to this correspondence in shape and the aforementioned engagement of the cavity adaptor 200 with the pin terminal 100, the cavity adaptor 200 retains the pin terminal 100 in the cavity 62. In the embodiment shown in FIG. 4, the outer shape 222 is formed to have a latching surface 226 at a front end in the longitudinal direction L engaging a latch 64 of the cavity 62, an outer diameter 227 corresponding to an inner diameter 66 of the cavity 62, and a sealing surface 228 adapted to receive a sealing element forming a seal between the cavity adaptor 200 and the cavity 62.

The embodiment shown in FIG. 4 is merely one example of an outer shape 222 that allows the cavity adaptor 200 to retain the pin terminal 100 in the cavity 62. The outer shape 222 can be any of a plurality of shapes formed during the overmolding and each corresponding to the cavity 62 of one of a plurality of housings 60 in which the pin terminal 100 is inserted and held. The same pin terminal 100 can therefore be produced simply and adapted for use in a variety of cavities in a variety of different housings.

Figure 5A:
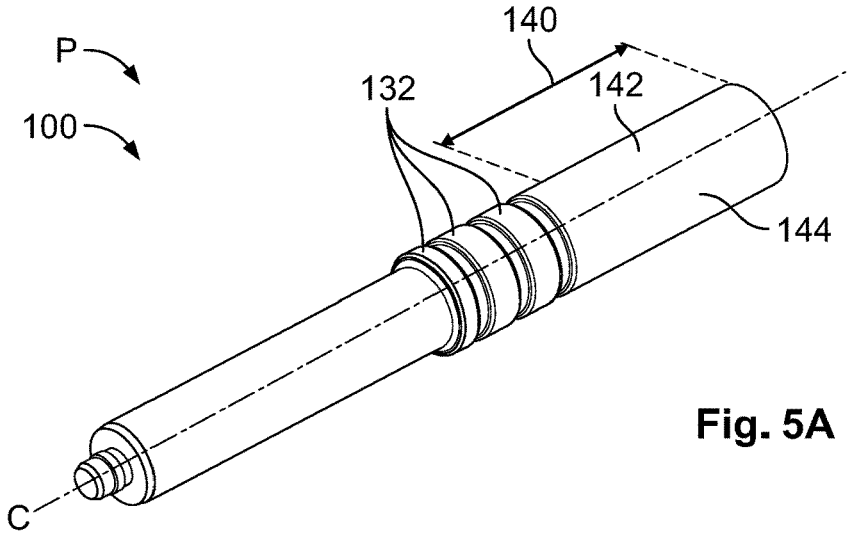
FIG. 5A is a perspective view of a pin terminal according to another embodiment in a pre-flattened state.
Figure 5B:
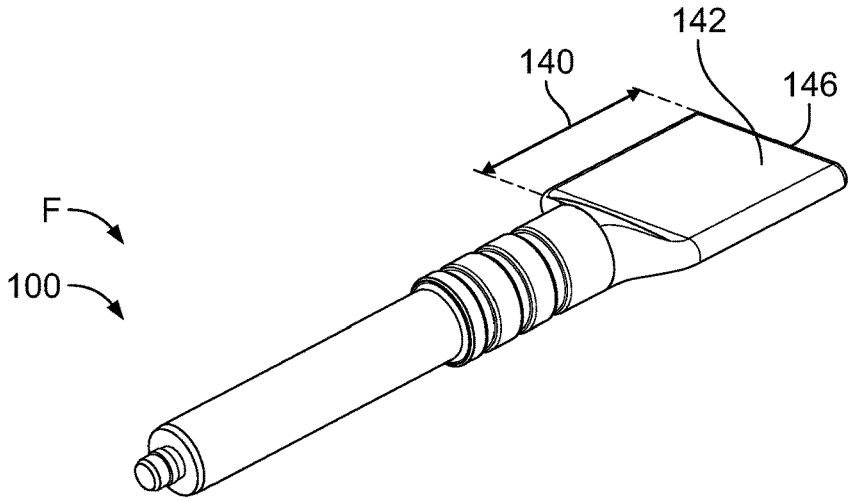
FIG. 5B is a perspective view of the pin terminal of FIG. 5A in a flattened state.
Figure 5C:
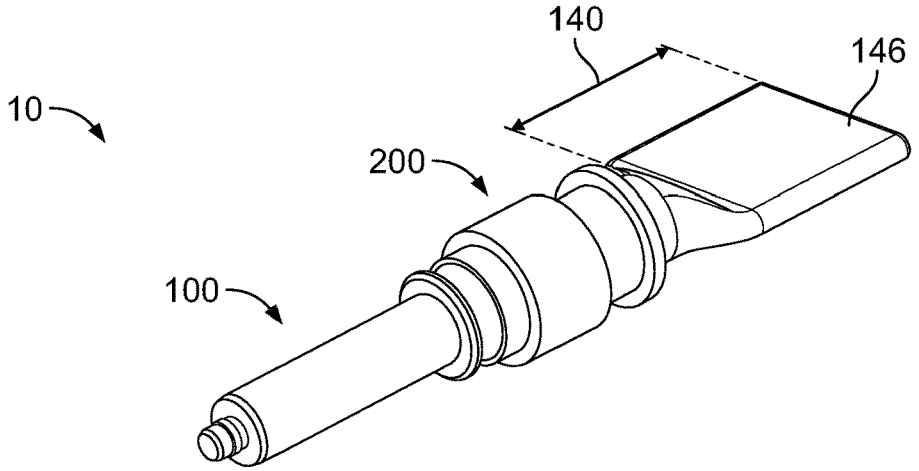
FIG. 5C is a perspective view of a pin terminal assembly according to another embodiment including the pin terminal of FIG. 5B.

A pin terminal 100 according to another embodiment is shown in FIGS. 5A, 5B, and 5C. Like reference numbers refer to like elements, and only the differences with respect to the pin terminal 100 shown and described with respect to FIGS. 1-4 will be described in detail herein.

The pin terminal 100 is shown in a pre-flattened state P in FIG. 5A and a flattened state F in FIG. 5B. In the pre-flattened state P, in the shown embodiment, the second connecting surface 142 of the second connecting section 140 protrudes a same distance from the central axis C as the pin protrusions 132. The second connecting surface 142 in the embodiment of FIG. 5A may alternatively protrude a smaller distance from the central axis C than the pin protrusions 132, as shown in the embodiment of FIG. 2. The second connecting section 140 is a solid cylindrical portion 144 in the embodiment shown in FIG. 5A; in other embodiments, the second connecting section 140 may be a hollow cylindrical portion.

The second connecting section 140 is flattened from the pre-flattened state P in FIG. 5A to the flattened state F in FIG. 5B, forming the second connection section 140 as a weld tab 146. The weld tab 146 is integral with the rest of the pin terminal 100. As shown in FIG. 5B, the weld tab 146 has the second connecting surface 142 formed on the weld tab 146 as a flat surface. As shown in FIG. 5C, the cavity adaptor 200 described with reference to FIGS. 1, 3, and 4 can be used with the pin terminal 100 having the weld tab 146 to form the pin terminal assembly 10.

Figure 6A:
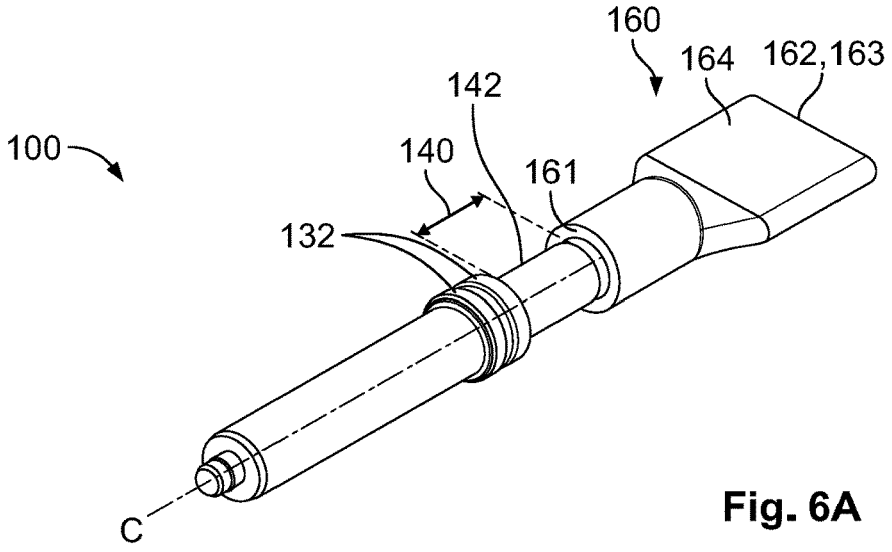
FIG. 6A is an exploded perspective view of a pin terminal according to another embodiment.
Figure 6B:
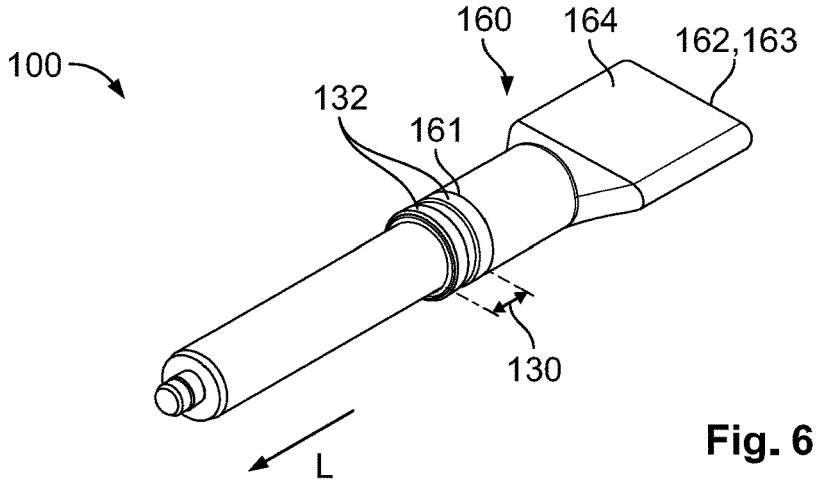
FIG. 6B is a perspective view of the pin terminal of FIG. 6A.

A pin terminal 100 according to another embodiment is shown in FIGS. 6A and 6B. Like reference numbers refer to like elements, and only the differences with respect to the embodiments of the pin terminal 100 shown and described with respect to FIGS. 1-5C will be described in detail herein.

The pin terminal 100 in the embodiment of FIGS. 6A and 6B includes a connecting tube 160 separate from the pin terminal 100 and attached to the second connecting section 140. The connecting tube 160 has a hollow cylindrical shape at a first end 161 and a weld tab 162 at a second end 163 opposite to the first end 161 in the longitudinal direction L. The weld tab 162 has a flat welding surface 164. The connecting tube 160 is formed from a highly conductive material. In an embodiment, the connecting tube 160 is formed from a same material as the pin terminal 100. In another embodiment, the connecting tube 160 may be formed from a different material than the pin terminal 100.

As shown in FIG. 6A, the second connecting surface 142 protrudes a smaller distance from the central axis C than the pin protrusions 132, similarly to the embodiment shown in FIG. 2. The first end 161 of the connecting tube 160 is complementary to and fits over the second connecting surface 142, moving along the longitudinal direction L until the first end 161 abuts a rearmost protrusion 132 of the retention section 130, as shown in FIG. 6B.

The connecting tube 160 begins as a hollow cylindrical tube. In the embodiment shown in FIGS. 6A and 6B, the weld tab 162 is flattened on the second end 163 before the first end 161 is positioned on the second connecting section 140. In another embodiment, similarly to the embodiment shown in FIGS. 5A and 5B, the connecting tube 160 is first positioned over the second connecting section 140 as the hollow cylindrical tube and the weld tab 162 is flattened after the first end 161 abuts the retention section 130.

Figure 7:
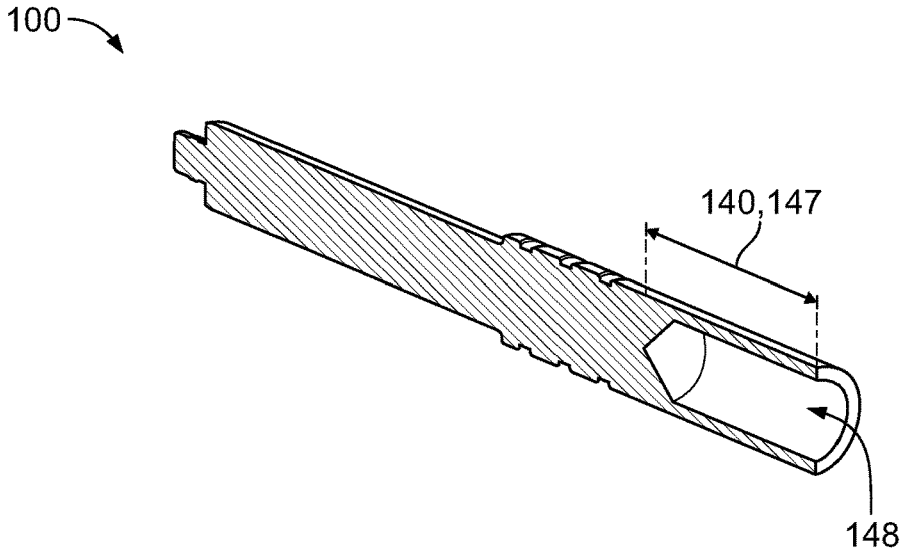
FIG. 7 is a sectional perspective view of a pin terminal according to another embodiment.

A pin terminal 100 according to another embodiment is shown in FIG. 7. Like reference numbers refer to like elements, and only the differences with respect to the embodiment of the pin terminal 100 shown and described with respect to FIG. 2 will be described in detail herein.

The second connecting section 140, alternatively to the solid cylindrical portion 144 shown in the embodiment of FIG. 2 and the weld tab 146, 162 shown in the embodiments of FIGS. 5A-6B, can be formed differently in other embodiments to allow the pin terminal 100 to connect to a wider range of second external components in various applications. In the pin terminal 100 shown in FIG. 7, the second connecting section 140 is a crimp barrel 147. To electrically connect the second connecting section 140 of the embodiment shown in FIG. 7 with the second external component, the second external component, such as a wire, is inserted into an opening 148 of the crimp barrel 147. The crimp barrel 147 is then crimped around the second external component to form the electrical connection.

A pin terminal assembly 10 according to another embodiment is shown in FIGS. 8-11. Like reference numbers refer to like elements, and only the differences with respect to the embodiment of the pin terminal assembly 10 shown and described with respect to FIGS. 1-5C will be described in detail herein.

Figure 8:
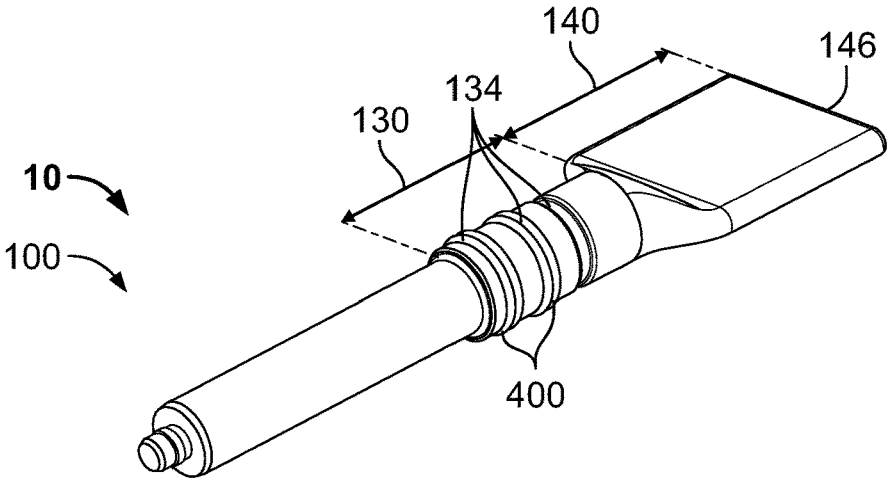
FIG. 8 is a perspective view of a pin terminal assembly according to another embodiment.
Figure 9:
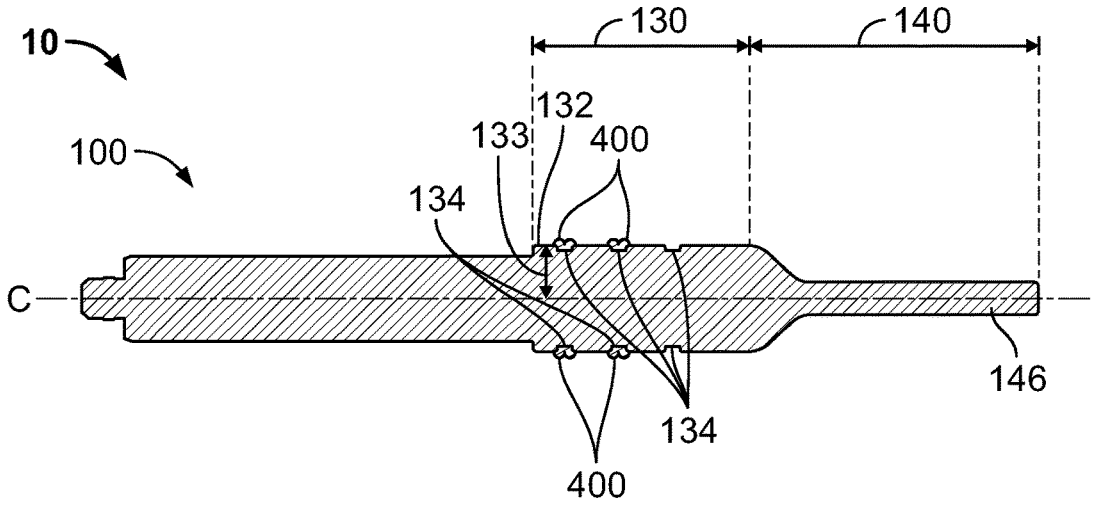
FIG. 9 is a sectional side view of the pin terminal assembly of FIG. 8.
Figure 10:
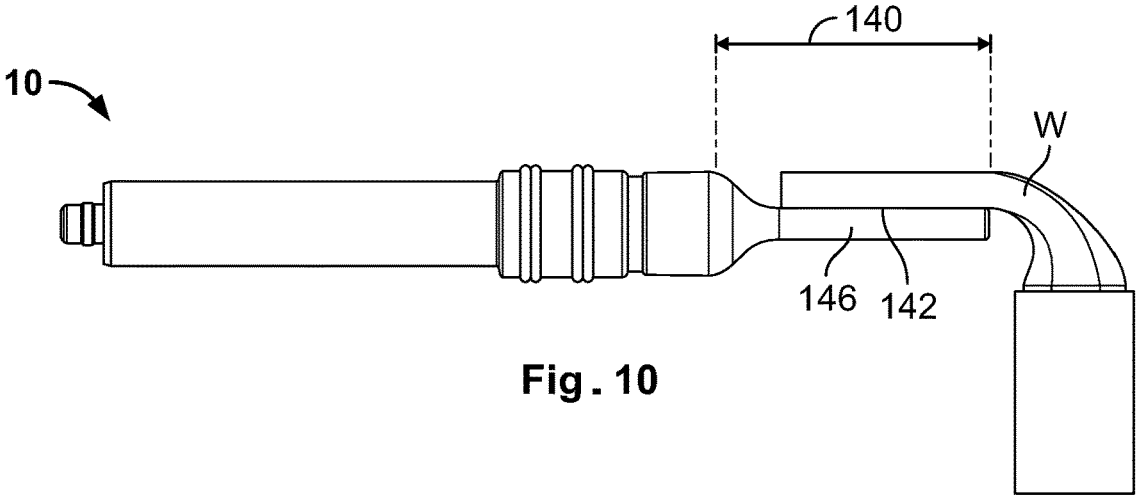
FIG. 10 is a side view of the pin terminal assembly of FIG. 8 attached to a wire.

The pin terminal assembly 10 shown in the embodiment of FIGS. 8-10 includes the pin terminal 100 and a plurality of seals 400 disposed on the pin terminal 100 in the retention section 130. Each of the seals 400 is formed of a non-conductive elastic material, such as a silicon rubber, and is overmolded in one of the grooves 134 of the retention section 130.

As shown in FIG. 9, the seals 400 each protrude further from the central axis C than the protrusion distance 133 of the pin protrusions 132. When the pin terminal assembly 10 is positioned in the cavity 62 of the housing 60, the seals 400 are compressed between the retention section 130 and the cavity 62, preventing ingress of foreign materials between the pin terminal 100 and the cavity 62.

As shown in the embodiment of FIGS. 8 and 9, the seals 400 are disposed in less than all of the grooves 134 of the retention section 130, leaving at least one of the grooves 134 open; in the shown embodiment, two seals 400 are disposed in two of the three grooves 134. In other embodiments, only one seal 400 may be disposed in only one of the grooves 134, or the seals 400 may be disposed in any other arrangement in the grooves 134. As will be described in greater detail below, the seals 400 can be used in conjunction with the cavity adaptor 200, which can engage a remaining groove 134 of the plurality of grooves 134 that does not contain a seal 400.

In the embodiment of the pin terminal assembly 10 shown in FIGS. 8-10, the second connecting section 140 has the weld tab 146. As shown in the embodiment of FIG. 10, the second external component is a wire W positioned in abutment with the weld tab 146 and welded to the weld tab 146, for example, by ultrasonic welding. In the embodiment shown in FIG. 10, the wire W is bent 90° before welding to lay flat on the flat second connecting surface 142 of the welding tab 146. In another embodiment, the weld tab 146 can be bent 90° before welding to the wire W, with the wire W remaining unbent. The description of the attachment of the wire W to the weld tab 146 with respect to FIG. 10 applies to any of the embodiments described herein that include the weld tab 146, 162.

Figure 11:
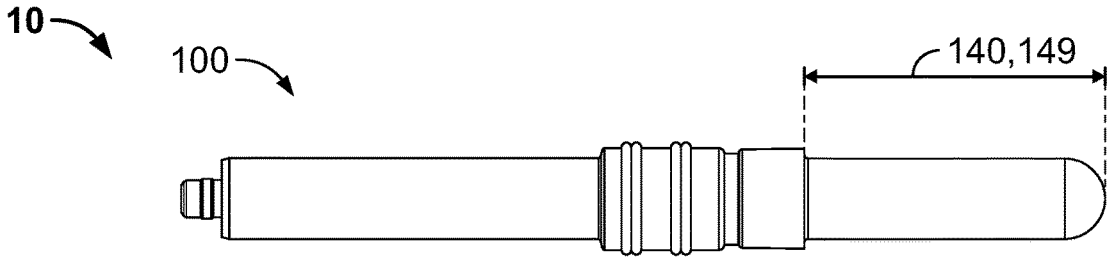
FIG. 11 is a side view of a pin terminal assembly according to another embodiment.

As shown in FIG. 11, in another embodiment, the pin terminal 100 could alternatively have a press-fit male portion 149 as the second connecting section 140. To electrically connect the second connecting section 140 of the embodiment shown in FIG. 11 with a second external component (such as a receptacle), the press-fit male portion 149 is inserted and press-fit into the second external component. The press-fit male portion 149 can be used interchangeably as the second connecting section 140 in combination with any of the embodiments described herein and is not limited to the exemplary embodiment shown in FIG. 11.

Figure 12:
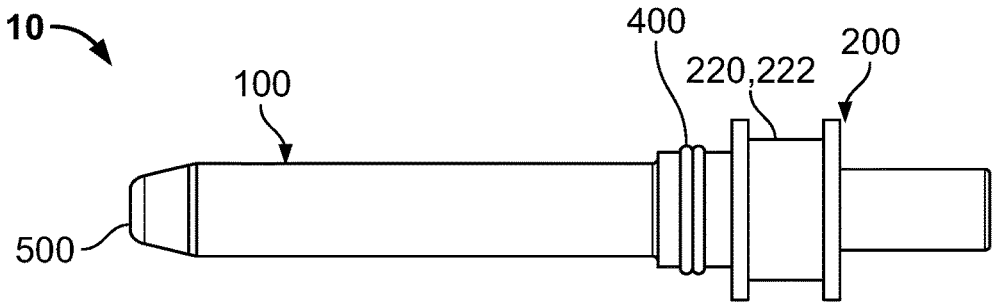
FIG. 12 is a side view of a pin terminal assembly according to another embodiment.
Figure 13:
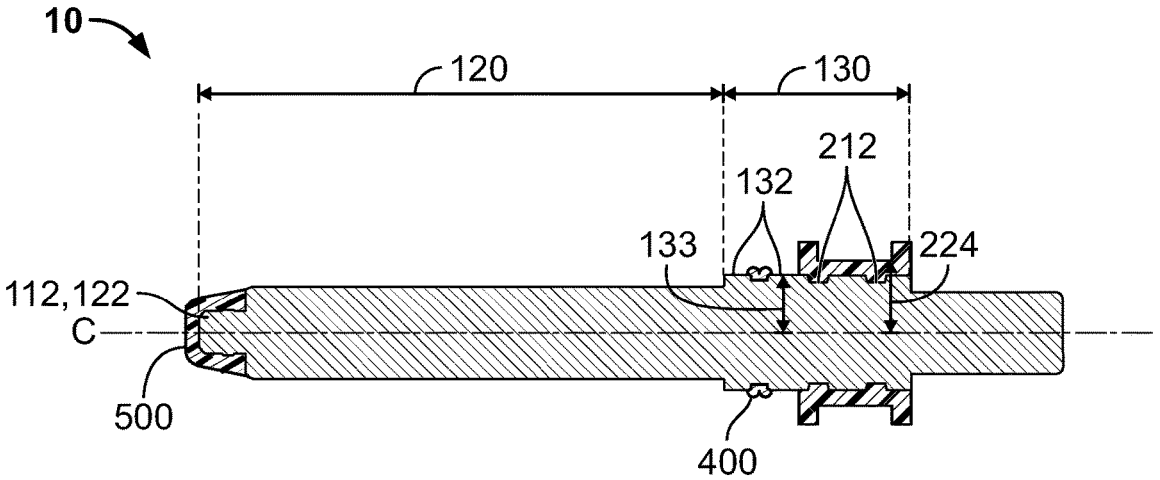
FIG. 13 is a sectional side view of the pin terminal assembly of FIG. 12.

A pin terminal assembly 10 according to another embodiment is shown in FIGS. 12 and 13. Like reference numbers refer to like elements and only the differences with respect to the embodiments of the pin terminal assembly 10 shown and described with respect to FIGS. 1-11 will be described in detail herein.

The pin terminal assembly 10, as shown in FIGS. 12 and 13, includes the pin terminal 100, the cavity adaptor 200 disposed on the retention section 130, the seal 400 disposed in one of the grooves 134, and a touch safe cap 500 disposed on the first end 112 of the pin terminal 100.

The cavity adaptor 200 of the embodiment shown in FIGS. 12 and 13 has an outer surface 220 with a different outer shape 222 than in the embodiment shown in FIGS. 1-4, and is adapted to fit a different cavity 62 than in the embodiment shown in FIGS. 1-4. The cavity adaptor 200 in the embodiment of FIGS. 12 and 13, similarly to the embodiment of FIGS. 1-4, has the adaptor distance 224 at a greater distance from the central axis C than the protrusion distance 133 of the pin protrusions 132 and has the adaptor protrusions 212 each engaging one of the grooves 134.

The adaptor protrusions 212, however, engage less than all of the grooves 134 in the embodiment of FIGS. 12 and 13; at least one of the grooves 134 is used for purposes other than securing the cavity adaptor 200 to the pin terminal 100 to expand the functionality of the pin terminal assembly 10 for various applications. In the exemplary embodiment shown in FIGS. 12 and 13, one of the grooves 134 is used for the seal 400 to allow the pin terminal assembly 10 to seal, for example, to the housing 60, while the remaining grooves 134 are sufficient to maintain a secure connection of the cavity adaptor 200 with the pin terminal 110. The seal 400 is overmolded in the groove 134 of the plurality of grooves 134 that is not engaged by the adaptor protrusions 212. The cavity adaptor 200 and the seal 400 are both overmolded on the retention section 130 in the embodiment shown in FIGS. 12 and 13.

The touch safe cap 500, shown in FIGS. 12 and 13, is disposed on the first end 112 of the pin terminal 100 and engages the cap mount 122. The touch safe cap 500 is formed of a non-conductive material and prevents contact with the first end 112, for example a touch from an operator, from conducting electrical current. The touch safe cap 500 is overmolded on the cap mount 122 and engages the cap mount 122. In an embodiment, the touch safe cap 500 is formed of a same material as the cavity adaptor 200.

What is claimed is:

1. A connector, comprising:

a housing having a cavity and defining a latch extending into the cavity; and a pin terminal assembly disposed in the cavity, the pin terminal assembly including a pin terminal formed of a conductive material and having a retention section with a plurality of grooves formed in an outer surface of the pin terminal, a cavity adaptor formed of a non-conductive material and engaging the retention section, and an elastic seal discrete from the cavity adaptor and overmolded in one of the plurality of grooves in the outer surface of the pin terminal, the cavity adaptor has an outer shape corresponding to the cavity and including a latching surface for engaging with the latch, the cavity adaptor retains the pin terminal in the cavity.

2. The connector of claim 1, wherein the latching surface is formed on a front end of the cavity adaptor, and the latch comprises a cantilevered arm extending in a direction toward the front end of the cavity adaptor.

3. A pin terminal assembly, comprising:

a pin terminal formed of a conductive material and having a retention section with a plurality of grooves formed in an outer surface of the pin terminal;

a cavity adaptor formed of a non-conductive material and engaging the retention section, the cavity adaptor has an outer shape corresponding to a cavity of a housing in which the pin terminal is inserted, the cavity adaptor retains the pin terminal in the cavity; and an elastic seal discrete from the cavity adaptor and overmolded in one of the plurality of grooves in the outer surface of the pin terminal.

4. The pin terminal assembly of claim 3, wherein the outer shape of the cavity adaptor is one of a plurality of shapes that each correspond to the cavity of one of a plurality of housings in which the pin terminal is inserted.

5. The pin terminal assembly of claim 3, wherein the retention section has a pair of pin protrusions, one of the plurality of grooves is disposed between the pair of pin protrusions.

6. The pin terminal assembly of claim 5, wherein the cavity adaptor has an adaptor protrusion on an inner surface engaging the groove and preventing movement of the cavity adaptor with respect to the pin terminal along a longitudinal direction of the pin terminal.

7. The pin terminal assembly of claim 5, wherein the pair of pin protrusions extend a same distance from a central axis of the pin terminal.

8. The pin terminal assembly of claim 7, wherein an outer surface of the cavity adaptor is positioned at a greater distance from the central axis than the pin protrusions and has a variation in distance from the central axis.

9. The pin terminal assembly of claim 3, wherein the retention section has a plurality of pin protrusions, each of the plurality of grooves is disposed between a pair of adjacent pin protrusions of the plurality of protrusions.

10. The pin terminal assembly of claim 9, wherein the cavity adaptor has a plurality of adaptor protrusions on an inner surface each engaging one of the plurality of grooves.

11. The pin terminal assembly of claim 10, wherein the inner surface of the cavity adaptor has a serpentine profile corresponding to an outer profile of the retention section.

12. The pin terminal assembly of claim 3, wherein the cavity adaptor is formed of a high temperature thermoplastic or a thermoset and is overmolded on the retention section.

13. The pin terminal assembly of claim 3, wherein the pin terminal has a first connecting section at a first end and a second connecting section at a second end, the retention section disposed between and connecting the first connecting section and the second connecting section.

14. The pin terminal assembly of claim 13, wherein the terminal has a plated portion and an unplated portion, the first connecting section is in the plated portion.

15. The pin terminal assembly of claim 13, further comprising a touch safe cap overmolded on a cap mount of the first connecting section.

16. The pin terminal assembly of claim 13, wherein the second connecting section is a weld tab welded to a wire.

17. The pin terminal assembly of claim 16, wherein the weld tab is formed by flattening the second connecting section or by attaching a connecting tube to the second connecting section and flattening the connecting tube.

18. The pin terminal assembly of claim 13, wherein the second connecting section is a crimp barrel or a press-fit male portion.

19. The pin terminal assembly of claim 3, further comprising a temperature sensor disposed in the cavity adaptor.

20. The pin terminal assembly of claim 3, wherein the non-conductive material of the cavity adaptor is more rigid than a non-conductive elastic material of the elastic seal.

21. The pin terminal assembly of claim 13, wherein the retention section has a pair of pin protrusions, one of the plurality of grooves is disposed between the pair of pin protrusions, the pair of pin protrusions extend a further distance from a central axis of the pin terminal than a first connecting surface forming an outer surface of the first connecting section.

22. The pin terminal assembly of claim 21, wherein a bottom of each of the grooves is positioned at a greater distance from the central axis of the pin terminal than the first connecting surface of the first connecting section.

* * * * *